United States Patent [19]

Davis et al.

[11] 4,154,345

[45] May 15, 1979

[54] FOOD PRODUCT CONTAINERS AND THE METHOD AND APPARATUS FOR MANUFACTURING SAME

[75] Inventors: Paul Davis, Swampscott; George K. Shumrak, Natick, both of Mass.

[73] Assignee: Sweetheart Plastics, Inc., Wilmington, Mass.

[21] Appl. No.: 880,087

[22] Filed: Feb. 22, 1978

[51] Int. Cl.[2] ..... B65D 51/16; B65D 85/72

[52] U.S. Cl. ..... 206/527; 220/DIG. 27; 222/541

[58] Field of Search ..... 206/525, 527; 229/43, 229/2.5; 150/0.5; 220/DIG. 27; 222/541

[56] References Cited

U.S. PATENT DOCUMENTS

| | | | |
|---|---|---|---|
| 2,750,294 | 6/1956 | Peters | 206/525 |
| 3,432,027 | 3/1969 | Mueller | 206/527 |
| 3,483,908 | 12/1969 | Donovan | 150/0.5 |

*Primary Examiner*—William T. Dixson, Jr.

*Attorney, Agent, or Firm*—Birch, Stewart, Kolasch & Birch

[57] ABSTRACT

A thermoplastic container is provided with a venting structure to enhance the delivery therefrom of food products, including toppings and the like, in an en mass or molded form from the container. A deep drawn rupturable tip is formed in a concave bottom web of the container which can be ruptured by a fingernail or fork tine to vent the bottom of the contents to atmosphere and enhance dispensing of the entire contents by inverting the container. The tip is of lesser depth than the bottom concavity to permit stacking of containers one upon the other and normal positioning on a flat surface.

8 Claims, 7 Drawing Figures

FOOD PRODUCT CONTAINERS AND THE METHOD AND APPARATUS FOR MANUFACTURING SAME

FIELD OF THE INVENTION

This invention relates to containers for food products such as frozen yogurt custard and the like in which a frangible vent hole is provided to enhance the discharge of the material contained therein from the mouth of the container.

BACKGROUND OF THE INVENTION

Many frozen confections, dairy products, custards and other semi-solid comestibles are packaged with syrups or toppings placed in the bottom of a container for the particular product and then the custard-like mass of product is filled into the container over the topping such that, in the case of a relatively wide-mouthed, tapered-wall container, the intended method of serving the food product with the topping thereon is to invert the open container on a serving dish and have the product with topping dispensed en mass from the wide-mouthed end of the container. Thus, a molded pudding or sundae-like product remains on the serving dish after dispensing.

In providing this type of product, there has been no satisfactory way of enhancing the discharge short of stabbing holes in the bottom of the container or heating the container to achieve a semi-liquid state of the material around the walls thereof in an effort to permit air to access into the container and the product to slide therefrom without distortion such that the resulting product has eye appeal to the user.

Because of the contortions and forces which must be exerted upon the product by these less than satisfactory prior art methods of discharging the products from their containers, the products are often distorted, blemished or otherwise rendered unsatisfactory to the eye even though their edibility may not be in question.

Accordingly, it is an object of the present invention to provide a new and novel container for semi-solid comestibles packaged with toppings at the bottom of the container and in which the container is adapted to be inverted to discharge the material therefrom.

Still another object of the present invention is to provide a new and novel rupturable vent means formed in the bottom of a container adapted to discharge topped comestibles from the mouth thereof by inverting the container.

Still another object of the present invention is to provide a means and method for manufacturing a container with a rupturable vent means in the bottom thereof.

Yet another object of the present invention is to provide a new and novel wide-mouthed frusto-conical container having a rupturable vent means formed in the bottom thereof in such a manner that the containers are readily stackable within a shipping carton or the like.

These and other objects of the present invention will become more fully apparent with reference to the following specification and drawings which relate to a preferred embodiment of the present invention.

SUMMARY OF THE INVENTION

Basically, the present invention comprises a drawn thermo-formed thermoplastic container formed from sheet polystyrene, polypropylene or the like, which includes a substantially wide-mouthed open top and a concave closed bottom portion having an outwardly projecting thin walled tip thermo-formed therein which may be readily ruptured by the fingernails of a user or by a sharp object, such as the tine of a fork, such that when the lid is removed from the container and the container is inverted, puncturing or fracturing the thin walled tip will enhance the discharge of the contents en mass from the container.

The containers are deep drawn by pressure and vacuum into cavity molds having a convex insert with a central cavity formed therein centered in the bottom of the cavity mold and the central cavity formed in the insert is of the desired configuration of the bottom rupturable tip to be formed in the concave bottom structure resulting from the mold shape.

The rupturable tip of the present invention is extremely thin relative to the remainder of the container and the bottom portion at its outermost end wall and is therefore readily rupturable by a fingernail, tine of a fork, or the like wielded by a user of the container to thereby vent the bottom of the container to atmosphere such that when the container is inverted, the contents will be readily discharged therefrom in a single mass. Also, the rupturable tip is completely within the concavity of the container bottom to permit seating or stacking on flat surfaces.

DETAILED DESCRIPTION OF THE DRAWINGS

Figure 1:
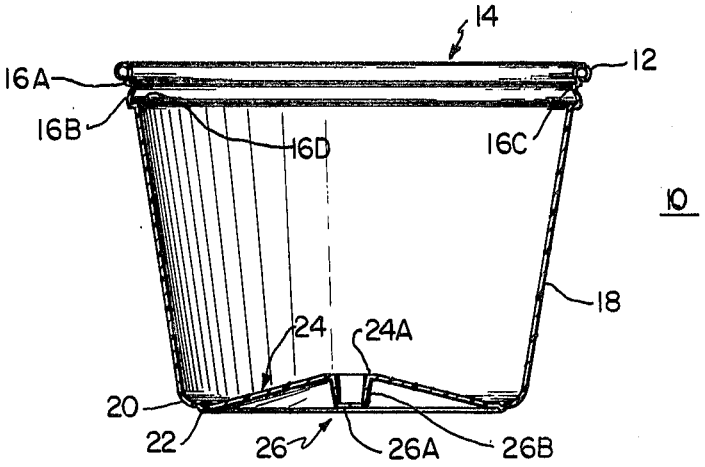
FIG. 1 is a schematic side elevation in cross-section of a container of the present invention.
Figure 2:
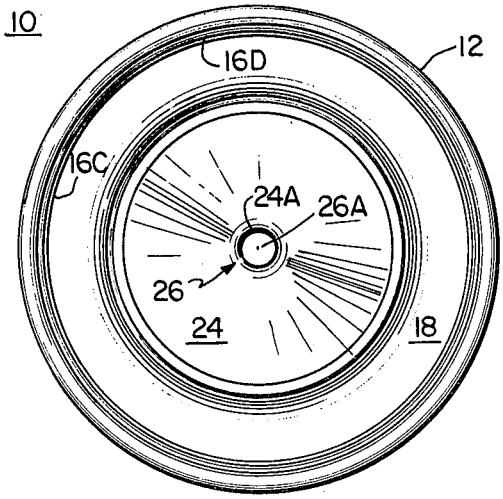
FIG. 2 is a top view of a container of the present invention with the lid removed therefrom.
Figure 3:
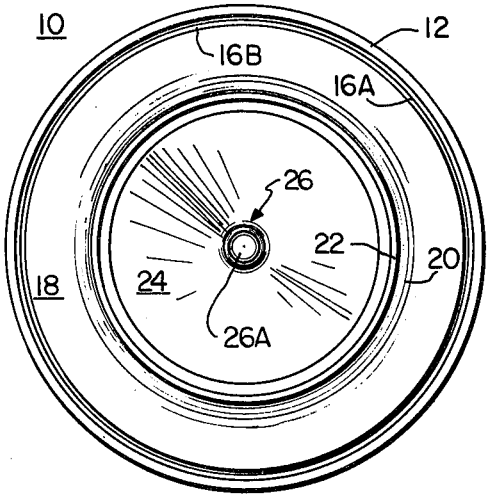
FIG. 3 is a bottom plan view of the container of the present invention.

Referring in detail to FIGS. 1, 2, 3 and 4, the container 10 of the present invention is shown as having a top curl 12 surrounding a wide-mouthed open end portion 14. Beneath the overturned top curl 12 are first and second annular rib portions 16A and 16B which appear internally of the cup as corresponding grooves as separated by a thin annular land 16C with the lowermost ring 16B providing internally thereof a seating shoulder 16D for receiving the depressed portion of a conventional internally seating snap-on container lid of a type well-known in the art which fits over the top curl 12 with an external skirt and has an internal skirt portion which comes down to seat on the internal seating shoulder 16D. From the shoulder 16D down to the lowermost portion of the container 10 extends a frusto-conical side wall 18, at a taper of approximately 9° to vertical in a preferred embodiment thereof, such that the overall container is generally frusto-conical in shape.

At the lower corners 20 of the side wall 18 and slightly inboard therefrom is a dependent annular boss 22 which is provided as a seating ring upon which the entire container 10 rests upon a given surface whether that surface be a supporting surface such as a table top or the central web portion of the lid of an adjacent container for the purpose of providing a nesting support for a plurality of containers 10 of the present invention.

Inboard of the annular seating or supporting boss 22 there is provided an arched bottom portion 24 which extends upwardly and inwardly to a flattened annulus 24A immediately surrounding the open interior end of a dependent rupturable tip 26 which is generally frustoconical in cross-section and which is closed at its lowermost extremity 26A.

Figure 4:
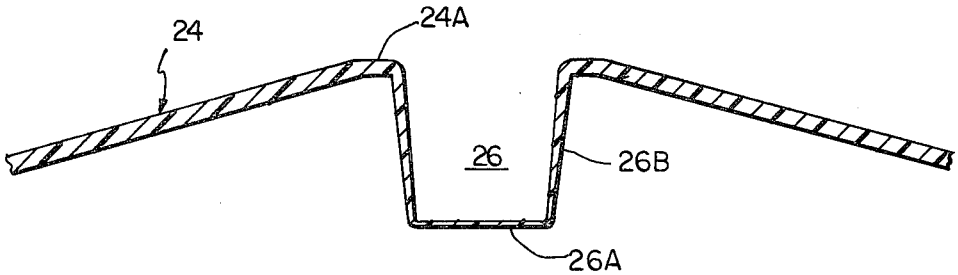
FIG. 4 is an enlarged cross-section of the detail of the concave bottom end rupturable tip portion of a container of the present invention.

As illustrated in FIG. 4, the rupturable dependent tip 26 includes tapered side wall portions 26B which extend from their thickest portion at the flattened annulus 24A down to their narrowest portion adjacent the bottom or end closure 26A such that the farther out on the rupturable extension from the container bottom 24, the thinner, more weakened and rupturable the material becomes.

It should be noted, however, that because of the annular boss 22 and the depth of the concavity of the arched bottom portion 24, the lowermost extremity or end surface 26A of the rupturable tip 26 does not engage any substantially flat surface upon which the container 10 is resting or nested.

In a preferred embodiment, for example, the thickness of the bottom wall 24 of the container 10 is on the order of 0.025 inches, the thickness of the flattened annulus 24A is on the order of 0.020 inches, the side walls 26B of the rupturable tip 26 taper from a thickness of 0.016 to a thickness of 0.0045 inches, and the thickness of the bottom or end wall 26A thereof is 0.0025 inches. The diameter of the outer end wall 26A is on the order of 0.188 inches, the side walls 26B are tapered at an angle of 7° from the vertical and the entire draw or depth of the rupturable tip 26 is on the order of 0.196 inches from the bottom outer edge of the flattened annular portions 24A.

The overall container dimensions in such a preferred embodiment have a lid seating diameter on the order of 2.983 inches, a side wall angle on the order of 9° to the vertical and an outside depth of 2.25 inches.

All of the foregoing is based upon the utilization, in forming, of a sheet of 0.029 inch to 0.035 inches in thickness at the start of the thermoforming process.

The foregoing dimensions are merely illustrative of a preferred embodiment and are not intended to be limiting of the present invention. However, it is critical to the present invention for the end wall 26A of the rupturable extension tip 26 to be readily rupturable or tearable with a fingernail, plastic fork tine or the like such that the lowermost portion of the contents of the container may be readily vented to atmosphere when the container is inverted. This will insure that dispensing may be performed in a facile manner without undue stress being exerted on the rupturable tip 26 to achieve the intended purpose of the present invention.

Figure 5:
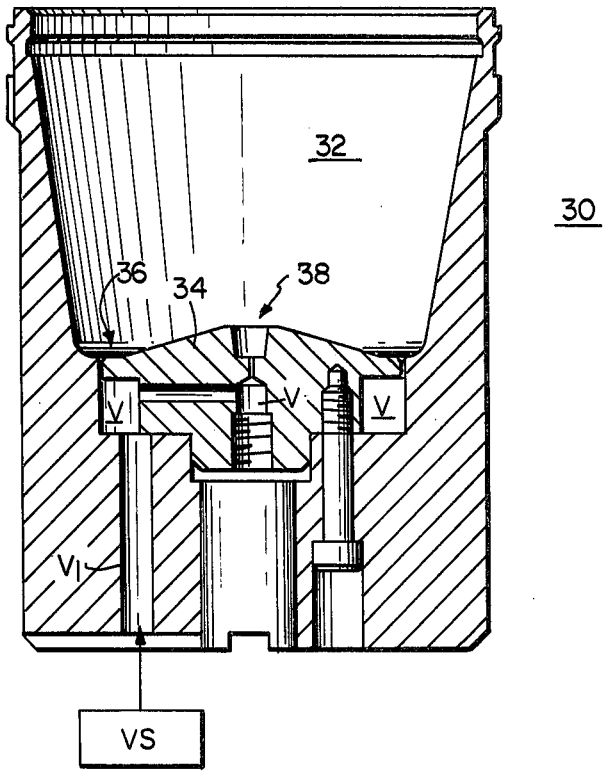
FIG. 5 is a side elevation in cross-section of a mold cavity and insert of the present invention.

Referring next to FIG. 5, the thermoforming mold 30 for the present invention is illustrated as having a main forming cavity 32 which is the same cross-sectional shape as the external shape of the container 10 and which has an insert 34 in the bottom thereof, which insert cooperates dimensionally with the cavity 32 to provide a reentrant shoulder forming annular groove 36 which produces the annular support boss 22 on the bottom of the cup and a cavity portion 38 defined centrally thereof which produces the rupturable tip 26 on the container 10.

As shown, vacuum ports V are provided in the lowermost portion of the mold 30 to provide vacuum from a source of vacuum VS through an input port V1 to the entire lowermost portion of the mold cavity through the annular groove 36 which defines the ultimate annular bead 22 on the container bottom 24 and to the bottom of the cavity 38 into which is drawn the rupturable tip formation 26 beneath the container bottom 24.

OPERATION OF THE INVENTION

Figure 6A:
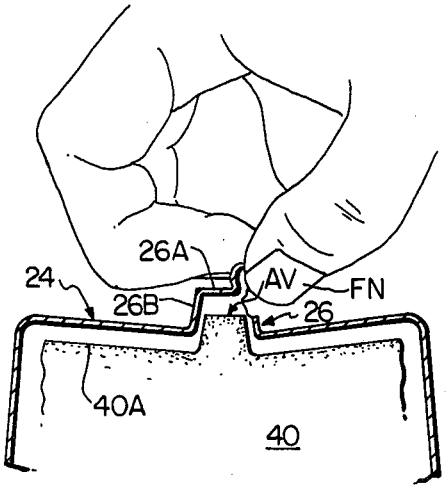
FIGS. 6A and 6B are schematics illustrating the rupturing and/or tearing away of a portion of the rupturable tip by fingernail and fork tine, respectively, with the container of the present invention inverted for the purpose of dispensing the contents thereof.

Referring now to FIG. 6A, there is shown an inverted container 10 with the fingernail FN on the finger of a user actually rupturing the rupturable tip 26 to permit air to flow into the bottom of the container 10 past the bottom 24 through the fractured or ruptured tip 26 as shown by the arrows AV, and thereby break the vacuum formed between the interior of the bottom 24 and the innermost portion 40A of the container contents 40 which may consist of, for example, syrup or sundae topping superimposed with a body of yogurt, ice cream, custard, frozen custard or other edibles of a similar nature.

By breaking or rupturing the rupturable tip 26 with the fingernail FN, the air flow is illustrated by the arrows AV precludes any suction from existing in the portion of the container defined by the side walls 18 and the bottom portion 24 and therefore, the contents are permitted to slide from the container 10 in a single mass such that the resulting serving is a molded and attractive confection having highly pleasing aesthetic characteristics to the ultimate user.

Figure 6B:
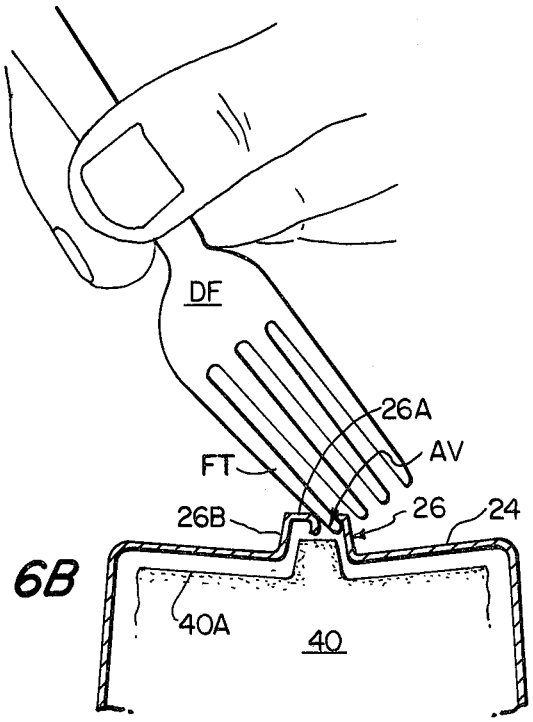

In FIG. 6B, the tine FT of a dinner fork DF is shown rupturing the tip 26 to achieve the same results as the fingernail FN in FIG. 6A.

It should be understood that the FOOD PRODUCT CONTAINERS AND METHOD AND APPARATUS FOR MANUFACTURING SAME of the present invention may be modified as would occur to one of ordinary skill in the art without departing from the spirit and scope of the present invention.

It is claimed:

1. In a thermoplastic container for containing a semi-solid food product, vent means communicating the lowermost portion of said food with atmosphere, when open, for enhancing the dispensing, en mass, of the said food product from the container when the latter is inverted, comprising:

a bottom wall on said container having an externally concave portion therein; and a hollow tip having a closed outer end drawn beneath said container in said concave portion and having sidewalls and a relatively thin rupturable skin defining said closed outer end for opening said vent means in response to an external rupturing force applied thereto.

2. The vent means of claim 1, wherein said concave portion is so dimensioned as to preclude said hollow tip from extending beyond the lowermost portion of said container.

3. A thermoplastic container for holding and dispensing, en mass, a semi-solid food product, comprising:

an annular structure for receiving a closure and defining an open container mouth;

a tapered sidewall extending from said annular shoulder downward to define a generally frusto-conical container;

a bottom web on said container;

an annular support shoulder interconnecting said bottom web with the lowermost extent of said sidewall;

a concave central portion defined in said bottom web; and a rupturable hollow tip drawn from said central web and extending therefrom into said concave portion within the outer extremities of said support shoulder.

4. The container of claim 3, wherein said rupturable hollow tip comprises a frusto-conical sidewall extending from a relatively thick portion adjacent said bottom web to a relatively thin lowermost extremity and a relatively thin rupturable web extending across and closing the lowermost portion of said sidewall.

5. A bottom structure for venting the interior of a thermoplastic container comprising:

a bottom web formed from a thermoplastic sheet material of a first thickness; and a hollow rupturable tip drawn from said bottom web and progressing from said first thickness to a substantially lesser and readily rupturable thickness of said thermoplastic material at the outermost extremity thereof.

6. The bottom structure of claim 5, wherein said bottom web is of a concave configuration of a first depth; and wherein said rupturable tip is centrally located in said concave configuration and of a second depth less than said first.

7. The bottom structure of claim 5, wherein said rupturable tip comprises a frusto-conical sidewall tapered from substantially said first to said lesser rupturable thicknesses and a web of said lesser rupturable thickness closing said tip across the lowermost extremity of said sidewall.

8. The bottom structure of claim 7, wherein said bottom web is of a concave configuration of a first depth; and wherein said rupturable tip is centrally located in said concave configuration and of a second depth less than said first.

* * * * *